US010309724B2

(12) United States Patent
Schromm et al.

(10) Patent No.: US 10,309,724 B2
(45) Date of Patent: Jun. 4, 2019

(54) DRYER AND METHOD FOR DRYING FLAT MATERIALS

(71) Applicant: Sandvik Materials Technology Deutschland GmbH, Duesseldorf (DE)

(72) Inventors: Hans-Kurt Schromm, Backnang (DE); Matthias Kleinhans, Waiblingen (DE); Manfred Gottlöber, Villingen (DE)

(73) Assignee: IPCO GERMANY GMBH, Fellbach (DE)

( * ) Notice: Subject to any disclaimer, the term of this patent is extended or adjusted under 35 U.S.C. 154(b) by 314 days.

(21) Appl. No.: 15/036,284

(22) PCT Filed: Oct. 22, 2014

(86) PCT No.: PCT/EP2014/072593
§ 371 (c)(1),
(2) Date: May 12, 2016

(87) PCT Pub. No.: WO2015/071058
PCT Pub. Date: May 21, 2015

(65) Prior Publication Data

US 2016/0282046 A1 Sep. 29, 2016

(30) Foreign Application Priority Data

Nov. 13, 2013 (DE) ..... 10 2013 223 150

(51) Int. Cl.

| | |
|---|---|
| ***F26B 3/00*** | (2006.01) |
| ***F26B 21/00*** | (2006.01) |
| ***F26B 13/10*** | (2006.01) |
| ***F26B 21/14*** | (2006.01) |

(52) U.S. Cl.
CPC ..... *F26B 21/004* (2013.01); *F26B 13/10* (2013.01); *F26B 21/14* (2013.01)

(58) Field of Classification Search
CPC ..... F26B 13/101; F26B 21/14
USPC ..... 34/444, 443, 413, 414
See application file for complete search history.

(56) References Cited

U.S. PATENT DOCUMENTS

| | | | |
|---|---|---|---|
| 3,245,334 | A | 4/1966 | Long |
| 4,999,927 | A | 3/1991 | Durst et al. |
| 5,147,690 | A | 9/1992 | Faust et al. |
| 5,201,132 | A | 4/1993 | Jacob |

(Continued)

FOREIGN PATENT DOCUMENTS

| | | |
|---|---|---|
| DE | 42 21 787 A1 | 1/1994 |
| EP | 1 921 407 A2 | 5/2008 |

(Continued)

OTHER PUBLICATIONS

Office Action of China Patent Office issued in Application No. 201480071610.9 with English translation dated Jan. 24, 2018 (16 pages).

(Continued)

*Primary Examiner* — John P McCormack
(74) *Attorney, Agent, or Firm* — Flynn Thiel, P.C.

(57) ABSTRACT

A dryer for flat materials, in particular panels, films or sheets, wherein a porous gas-permeable metal plate is provided for arranging at a distance from the flat material which is to be dried, wherein an arrangement is provided for delivering a gaseous fluid through the metal plate, and wherein the metal plate is of a metal foam.

20 Claims, 7 Drawing Sheets

(56) References Cited

U.S. PATENT DOCUMENTS

Figure 1:
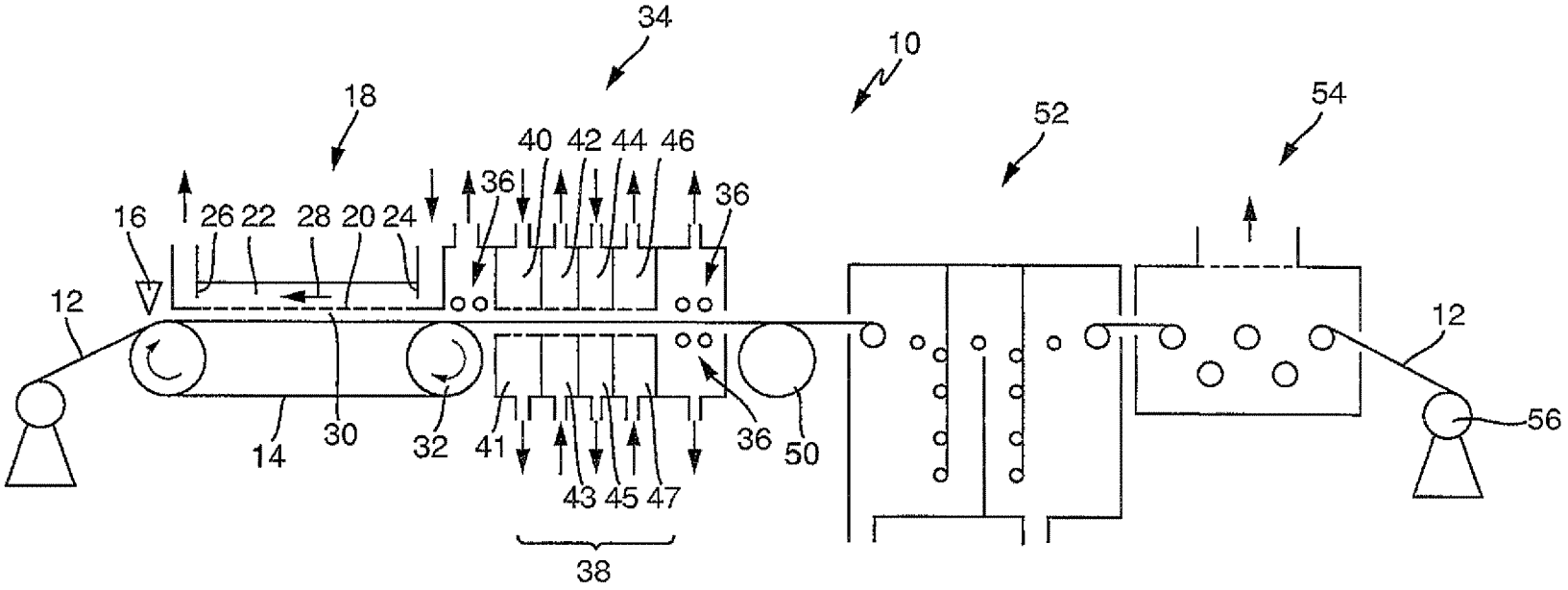

| | | | | |
|---|---|---|---|---|
| 5,293,699 | A | 3/1994 | Faust et al. | |
| 9,068,777 | B2 * | 6/2015 | Savarese | F26B 3/28 |
| 9,878,307 | B2 * | 1/2018 | Seals | B01J 23/755 |
| 2010/0178546 | A1 * | 7/2010 | Rijssenbeek | H01M 2/0252 429/131 |
| 2011/0076736 | A1 * | 3/2011 | Matsumoto | H01M 8/16 435/177 |
| 2013/0228300 | A1 | 9/2013 | Unger et al. | |

FOREIGN PATENT DOCUMENTS

| | | | |
|---|---|---|---|
| GB | 847 548 | | 9/1960 |
| JP | 60-156536 | A | 8/1985 |
| JP | 2-17966 | A | 1/1990 |
| JP | 3-98673 | A | 4/1991 |
| JP | 5-208764 | A | 8/1993 |
| JP | 6-23912 | Y2 | 2/1994 |
| JP | 7-40454 | A | 2/1995 |
| JP | 2002-195755 | A | 7/2002 |
| JP | 2003-25548 | A | 1/2003 |
| JP | 2004-66042 | A | 3/2004 |
| JP | 2004-225954 | A | 8/2004 |
| JP | 2013-57427 | A | 3/2013 |

OTHER PUBLICATIONS

Form PCT/ISA/210 issued in PCT/EP2014/072593 with English translation dated Jan. 23, 2015 (6 pages).

Form PCT/ISA/237 issued in PCT/EP2014/072593 dated Jan. 23, 2015 (6 pages).

Office Action of European Patent Office issued in European Application No. 14 786 683.4 dated Sep. 14, 2018 (5 pages).

Office Action of Japan Patent Office issued in Japan Application No. 2016-530169 with English translation dated Jul. 31, 2018 (11 pages).

Notice of Allowance issued in corresponding Japanese Appln. No. 2016-530169 dated Feb. 5, 2019.

* cited by examiner

DRYER AND METHOD FOR DRYING FLAT MATERIALS

The invention relates to a dryer for flat materials, in particular panels, films or sheets. The invention also relates to a method for drying such flat materials.

The invention is intended to specify an improved dryer for flat materials and an improved method for drying flat materials and by means of which even extremely sensitive flat materials, for example very thinly coated panels or sensitive, in particular coated films or sheets, can be dried quickly and, in the process, in an extremely sensitive manner.

The invention provides, for this purpose, a dryer for flat materials, in particular panels, films or sheets, wherein a porous, gas-permeable metal plate is provided for arranging at a distance from the flat material which is to be dried, wherein means are provided for delivering a gaseous fluid through the metal plate, and wherein the metal plate consists of a metal foam.

Since the gaseous fluid is delivered through the metal plate made of porous, gas-permeable metal foam, that is to say open-pore metal foam, it is possible to achieve an extremely uniform flow distribution of the gaseous fluid over the flat material which is to be dried. Using a porous, gas-permeable metal plate made of open-pore metal foam makes it possible for in particular locally relatively high flow speeds, which quite inevitably result in a non-uniform drying process of the flat material which is to be dried, to be avoided altogether. In relation to dryers which operate using a plurality of individual nozzles, the invention can thus be used to set uniform flow conditions and a flow speed which is uniform over the entire surface area of the flat material which is to be dried, and this therefore also makes it possible to achieve extremely uniform and sensitive drying.

In a development of the invention, the means for delivering a gaseous fluid have intake means for taking in gas from a region between the metal plate and the flat material which is to be dried.

Particularly sensitive drying can be achieved by virtue of gas being taken in from the region between the metal plate and the flat material which is to be dried since, rather than flow being directed on to the flat material which is to be dried, the only flow generated is directed away from the flat material which is to be dried. This results in a negative pressure being generated between the metal plate and the flat material which is to be dried. Provision may be made, if appropriate, for gas to flow laterally into the space between the metal plate and the flat material which is to be dried, said gas then, in order to achieve uniform flow distribution, advantageously likewise flowing in through a metal plate made of an open-pore metal foam. It is also possible, however, for the negative pressure to be set to such a low level that only insignificant quantities of gas flow in and essentially only gases or vapors escaping from the flat material which is to be dried are extracted by suction.

Irrespective of whether gaseous fluid is delivered through the open-pore metal foam in the direction of the flat material which is to be dried or is taken in from the space between the open-pore metal foam and the flat material which is to be dried, it is possible for the metal plate made of the metal foam to be arranged obliquely in relation to the flat material which is to be dried. This allows a gas distribution in the space between the metal plate and the flat material which is to be dried to be influenced such that the desired flow conditions are present in the space between the metal plate and the flat material which is to be dried.

In a development of the invention, the means for delivering a gaseous fluid have at least one flow space, which is bounded on one side by a surface of the metal plate, wherein said surface is directed away from the flat material which is to be dried, wherein the flow space has at least one entry opening and at least one exit opening for delivery gas and is designed to guide the delivery gas past that surface of the metal plate which is located in the flow space, in order to generate an intake action through the metal plate.

These measures can generate an intake action by means of the so-called Venturi effect. The gaseous fluid, which may be, for example, nitrogen, a noble gas or some other suitable gas, is guided past that surface of the metal plate which is directed away from the flat material which is to be dried. A relatively high flow speed is preferably achieved here. The gaseous fluid then flows past the many open pores in the open-pore metal foam. As a result of the so-called Venturi effect, this gives rise to a suction action, by means of which gas located in the space between the metal plate and the flat material which is to be dried, that is to say in the drying space, is sucked outward through the pores of the metal foam. This takes place here uniformly over the entire surface area of the metal plate, since the metal plate has open pores over its entire surface area. In the drying space between the metal plate and the flat material which is to be dried, it is thus possible for essentially constant flow conditions to be generated over the entire surface area.

In a development of the invention, a plurality of flow spaces, each with at least one entry opening and at least one exit opening, are arranged one behind the other in the longitudinal direction of the material which is to be dried.

This means that it is possible for example for different flow speeds to be set in the flow spaces. For example, the flow speed in a flow space in which the drying process is just beginning is set to a very low level, so that the still liquid or gel-like flat material is treated particularly sensitively and only a small amount of gas is taken in from the drying space. As an alternative, it is also possible to set a very high flow speed in such a front flow space, so that the drying process is accelerated right from the start. Flow spaces which are located above flat material which has already been pre-dried can then be set such that a negative pressure which is ideal for the respective material which is to be dried is set in the drying space.

In a development of the invention, the metal plate is arranged above a circulating belt, to which a liquid material is applied in order to produce the flat material, said material solidifying on the belt.

This means that it is possible, during the production of films or sheets, for the liquid material applied to a belt to be dried extremely sensitively and, in the process, efficiently, immediately following the application operation.

In a development of the invention, in each case at least one airlock is provided upstream and/or downstream of a drying space of the dryer, wherein the airlock has at least one bar-like or rod-like strip arranged transversely to the longitudinal direction of the flat material which is to be dried, wherein the flat material is moved past the strip in the longitudinal direction, wherein the strip, at least over a part of its outer surface which is directed toward the flat material, consists of porous, gas-permeable metal foam, and wherein means are provided for delivering airlock gas through the metal foam in the direction of the flat material.

The bar-like or rod-like strips may thus comprise a metal-foam strip or also a tubular rod made of metal foam. In the case of a tubular rod, the airlock gas can be introduced into the interior of the rod and then exits in the outward direction through the metal foam. Regions of the outer surface of the rod which are directed away from the material which is to be dried can be sealed here. Such sealing can be achieved by re-grinding the metal foam, but also, for example, by the application of a sealing compound, for example of an adhesive.

In a development of the invention, the metal foam consists of a stainless steel, in particular of chromium-nickel stainless steel.

Using chromium-nickel stainless steel allows the metal foam to be very corrosion-resistant and also to be used in corrosive environments. This is also essential so that corrosion products of the metal foam do not fall from the metal foam onto the material which is to be dried and can thus contaminate the latter.

In a development of the invention, the metal foam is between 45% and 80% nickel and between 15% and 45% chromium. The metal foam advantageously has carbon, copper, iron, molybdenum, manganese, phosphorus and/or zinc, the percentage of each being less than 1%.

In a development of the invention, the metal foam has a porosity of 90% or more.

The porosity relates to the cavities in the foamed metal. A porosity of 90% means that 90% of the overall volume of the metal foam consists of air or cavities and only 10% consists of solid material.

In a development of the invention, the metal foam has an average pore size ranging between 0.3 mm and 2.5 mm.

The pore sizes of metal foam are distributed more or less statistically; on average, they may be between 0.3 mm and 2.5 mm. The average pore size here is coordinated with the desired passage of gaseous fluid through the metal foam.

The problem on which the invention is based is also solved by a method for drying flat materials, in particular panels, films or sheets, wherein at least one metal plate made of porous, gas-permeable metal foam is arranged at a distance from the flat material which is to be dried and gaseous fluid is delivered through the metal plate.

Using a plate made of open-pore metal foam makes it possible for very uniform flow conditions to be set in a region between the metal plate and the flat material which is to be dried, that is to say the drying space, said very uniform flow conditions allowing very sensitive and, in the process, efficient drying.

In a development of the invention, the flat material which is to be dried is guided past the metal plate.

Such guidance of the flat material is expedient, in particular, in the case of web-formed flat materials, for example films or sheets, in order to achieve continuous operation. The method according to the invention, however, may also be used in so-called batch operation, that is to say in which the material which is to be dried is arranged in an immovable manner beneath the dryer. Such batch operation can be used for research purposes, but also when the intention is to dry for example coated glass panels and continuous drying operation is not absolutely necessary.

In a development of the invention, provision is made for gaseous fluid to be taken in through the metal plate from a region between the flat material and the metal plate.

Taking in gaseous fluid from the drying space allows particularly sensitive and, in the process, efficient drying of the flat material to take place.

In a development of the invention, provision is made for a first metal plate to be arranged at a distance from a first surface of the flat material and for at least a second metal plate to be arranged at a distance from a second surface of the flat material and for gaseous fluid to be delivered through the first and second metal plates.

This allows the two opposite surfaces of the flat material to be dried at the same time.

In a development of the invention, provision is made for the flat material to be dried contactlessly in the region between the two metal plates.

In a development of the invention, provision is made for delivery gas to be guided past a metal-plate surface which is directed away from the flat material which is to be dried and for gaseous fluid to be taken in through the metal plate by means of the delivery gas guided past.

These measures allow the so-called Venturi effect to be used in order for gas to be taken in from the drying space through the pores of the metal foam. The gas is taken in here over the entire surface area of the metal plate, and therefore very uniform flow conditions are achieved in the drying space.

Further features and advantages of the invention can be gathered from the claims and from the following description of preferred embodiments of the invention in conjunction with the drawings. Individual features of the different embodiments and from the individual figures may be combined here in any desired manner without departing from the framework of the invention.

Figure 2:
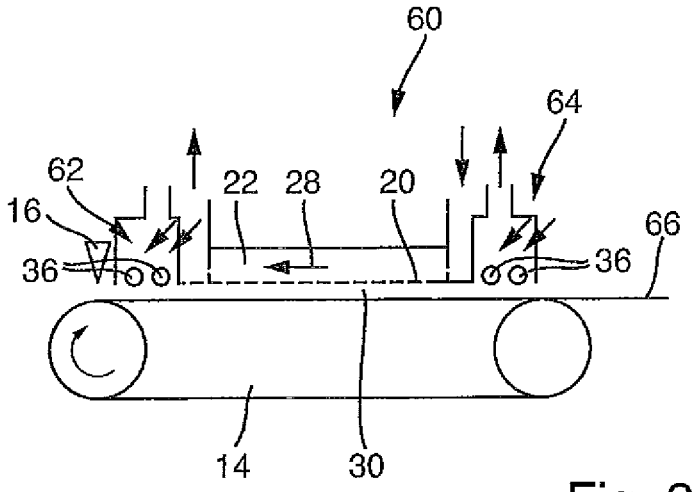
Figure 3:
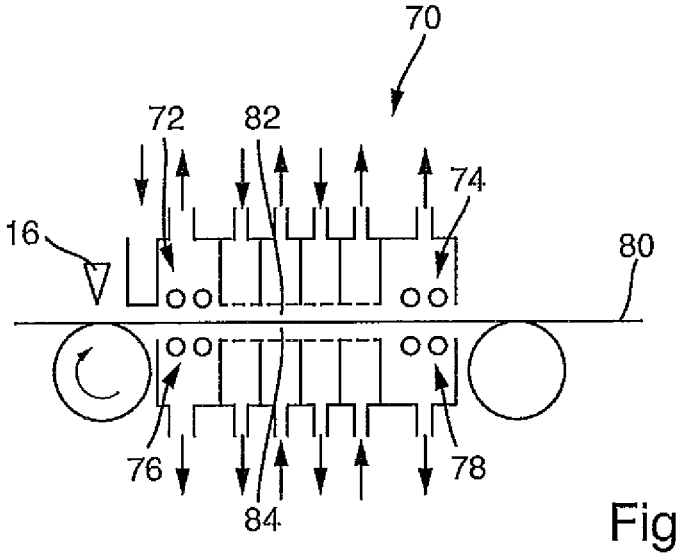
Figure 4:
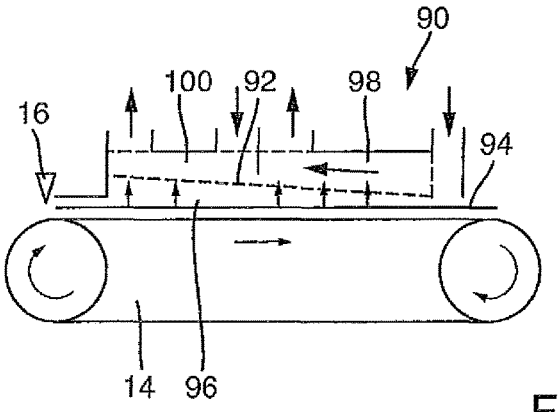
Figure 5:
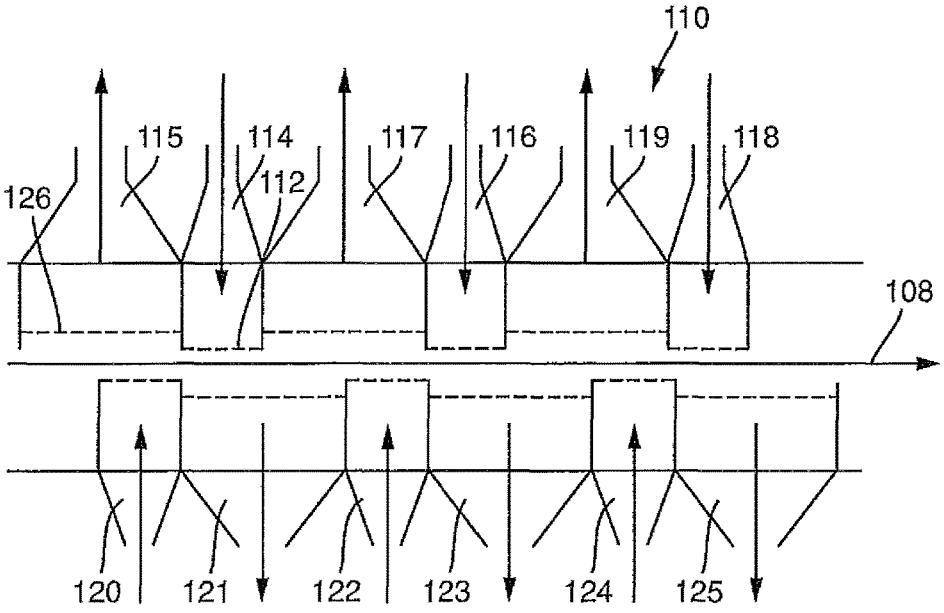
Figure 6:
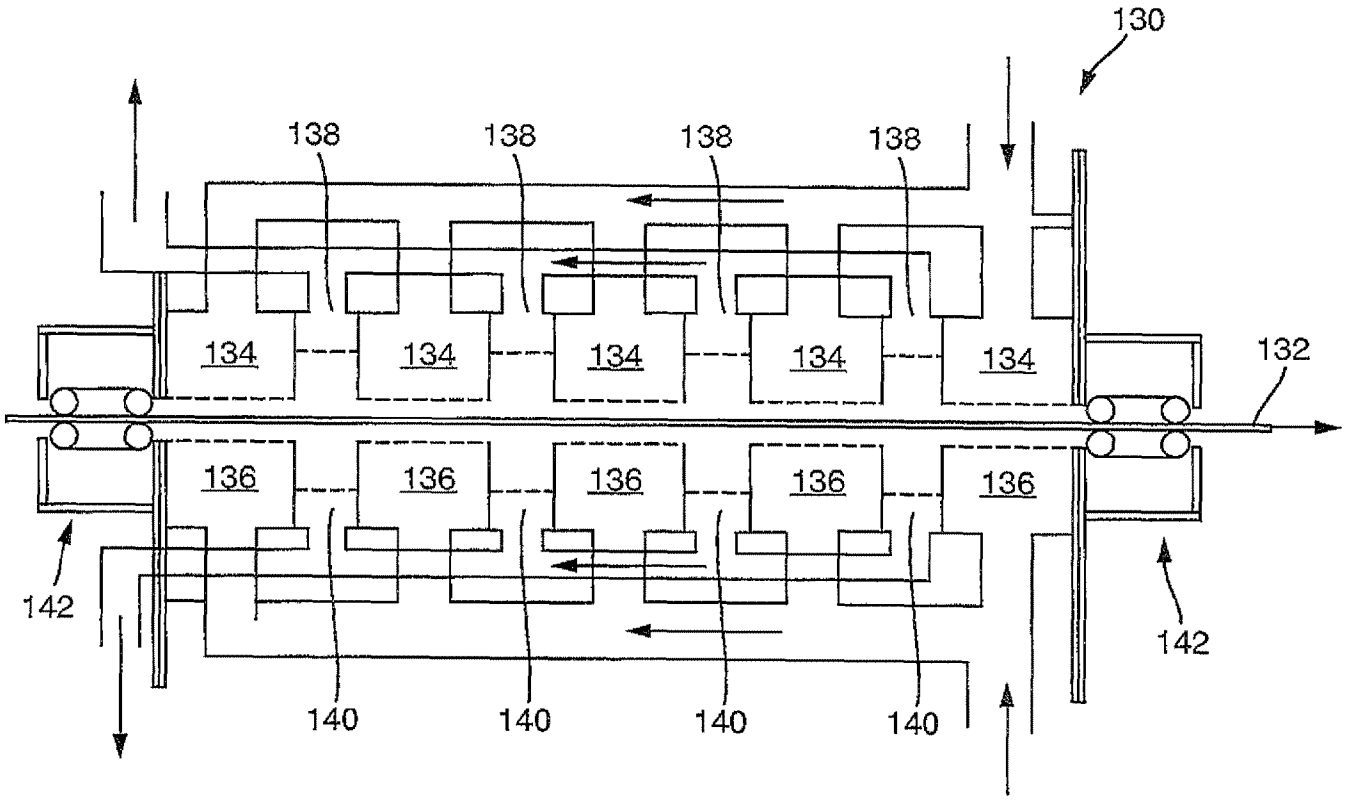
Figure 7:
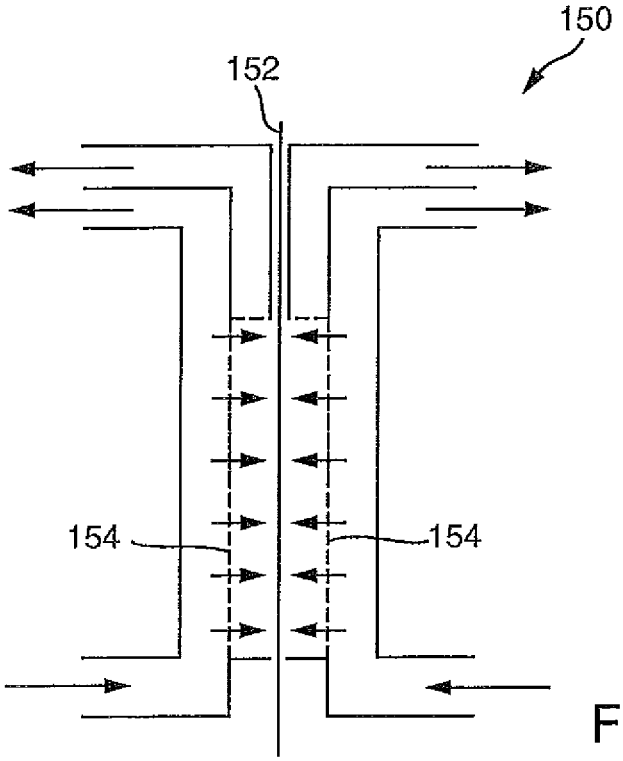
Figure 8:
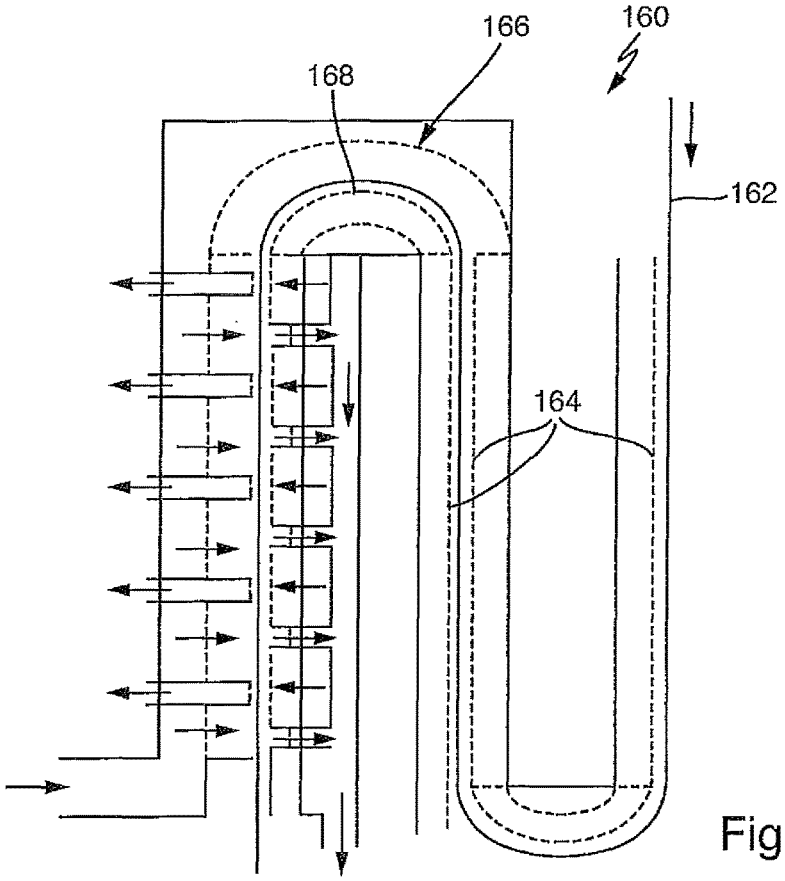
Figure 9:
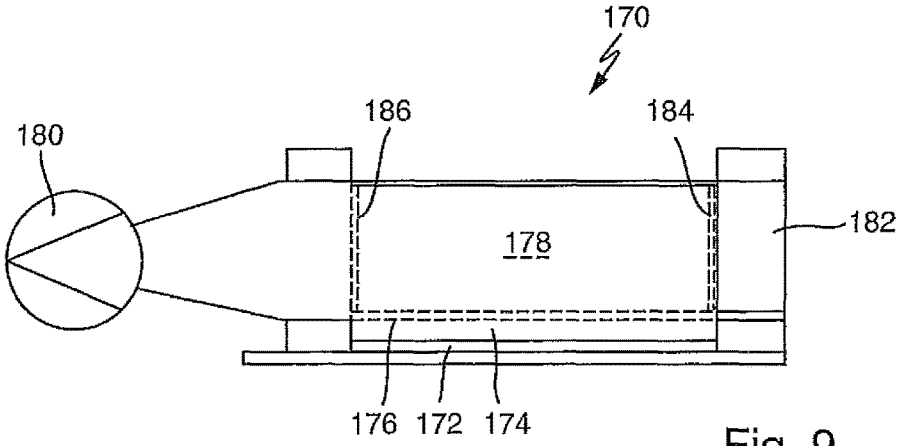
Figure 10:
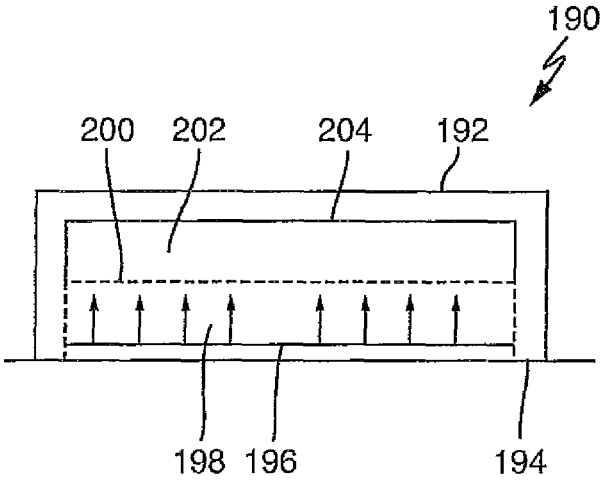
Figure 11:
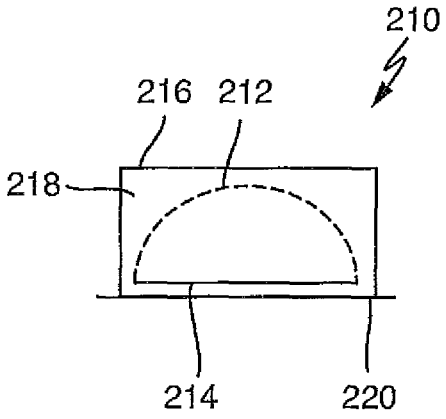

In the drawings:

FIG. 1 shows a schematic illustration of a plant for producing web-form flat materials, having two dryers according to the invention arranged one behind the other, FIG. 2 shows a schematic illustration of a further dryer according to the invention, FIG. 3 shows a schematic illustration of a further embodiment of a dryer according to the invention, FIG. 4 shows a schematic illustration of a further embodiment of a dryer according to the invention, FIG. 5 shows a schematic illustration of a further embodiment of a dryer according to the invention, FIG. 6 shows a schematic illustration of a further embodiment of a dryer according to the invention, FIG. 7 shows a schematic illustration of a further embodiment of a dryer according to the invention, FIG. 8 shows a schematic illustration of a further embodiment of a dryer according to the invention, FIG. 9 shows a schematic illustration of a further embodiment of a dryer according to the invention, FIG. 10 shows a schematic illustration of a further embodiment of a dryer according to the invention, and FIG. 11 shows a schematic illustration of a further embodiment of a dryer according to the invention.

The schematic illustration of FIG. 1 shows a plant 10 for producing web-form materials, for example film or sheet. A through-passage direction runs from left to right in the illustration of FIG. 1. From a drum 12, a sheet which is to be coated or a separating sheet is drawn off and guided onto the upper strand of a circulating belt 14. A device 16 for applying liquid material is provided at the beginning of the upper strand of the belt 14. Said application device 16 is designed, for example, in the form of a slotted nozzle, which extends over the entire width of the belt 14. Said application device 16 is used to apply to the belt 14, in particular a steel belt, material for a sheet which is to be cast, and the finished sheet can then be drawn off at the end of the upper strand of the belt 14.

The liquid material is applied to the belt 14 and then solidifies or dries as the belt 14 moves. The liquid material is applied by the application device 16 to the upper side of the sheet which is to be coated, said sheet being arranged between the belt 14 and the application device 16. A dryer 18 according to the invention is arranged above the upper strand of the circulating belt 14. The dryer 18 has a porous, gas-permeable metal plate 20, which is made of metal foam and is arranged at a constant distance above the flat material which is to be dried, said material resting in the form of a film, from the application device 16, on the upper strand of the belt 14 or on the upper side of the sheet. The metal plate 12 has arranged above it a flow space 22, which is closed off in the upward direction by a gas-impermeable plate and is closed off to the sides by means of gas-permeable plates 24, 26. The plates 24, 26 here may likewise consist of open-pore metal foam, but may also be, for example, straightforward perforated plates, so as to achieve uniform flow through the flow space 12.

The plates 24, 26 form, at the same time, a respective entry opening and exit opening for the flow space 22. Gas is introduced into the flow space 22 through the plate 24, and the gas leaves the flow space 22 again through the plate 26. The gas here flows within the drying space in the direction of an arrow 28 and thus flows past the open pores of the metal plate 20. The so-called Venturi effect thus gives rise, within the pores of the metal plate 20, to a negative pressure, which ultimately results in gas being taken in from a drying space 30 between the metal plate 20 and the flat material which is to be dried on the upper strand of the belt 14. Said gas is then channeled away through the plate 26 together with the gas which flows through the flow space 22. Gas is taken in from the drying space 30 here over the entire underside of the metal plate 20, and therefore essentially constant flow conditions are achieved in the drying space over the entire length of the metal plate 20. The web-formed film on the upper strand of the circulating belt 14 can thus be dried very sensitively and uniformly, but at the same time also efficiently and quickly.

In the region of a deflecting drum 32 for the circulating belt 14, said deflecting drum being arranged on the right in FIG. 1, the coated carrier sheet 12 leaves the circulating belt 14 and is introduced into a floatation dryer 34 according to the invention. The floatation dryer 34 has, at its upstream end, an airlock with two tubular rods 36 extending transversely to the longitudinal direction of the web-formed material which is to be dried. These rods 36 consist, at least in part, of metal foam and serve to deliver an airlock gas in the direction of the web-formed material which is to be dried, and thus to prevent ambient gas from being introduced into the actual drying region of the floatation dryer 34 downstream of the airlock 36. Essentially identical airlocks with tubular rods 36 are also arranged at the downstream end of the floatation dryer 34, wherein a respective airlock with two tubular rods 36 is arranged at the downstream end, both above and beneath the web-formed material which is to be dried.

A plurality of flow spaces 40, 42, 44 and 46 are arranged one behind the other, as seen in the through-passage direction of the web-formed material, in the actual drying region 38 of the floatation dryer 34. In the same way, a plurality of flow spaces 41, 43, 45 and 47 are arranged one behind the other opposite the underside of the web-formed material. The flow spaces 40 to 48 here are bounded in the direction of the web-formed material which is to be dried in each case by means of a metal plate made of open-pore and therefore gas-permeable metal foam. Gas is delivered into the flow spaces 40, 44 and also 43 and 47 here, through the respective metal plate, in the direction of the web-formed material which is to be dried. On the one hand, this ensures that the web-formed material is kept in a floating state centrally between the opposite metal plates of the flow spaces 40 to 48. At the same time, the gas is guided over the upper side and the underside of the web-formed material, and the latter is therefore dried. In contrast, gas is extracted by suction from the flow spaces 42, 46, 41 and 45. It is thus possible to create stable flow conditions in the regions above and beneath the web-formed material which is to be dried, since for example the gas delivered through the metal plate of the flow space 40 in the direction of the web-formed material is extracted by suction again through the metal plate of the flow space 42.

The flow spaces 40 and 43, through the metal plates of each of which gas is delivered in the direction of the web-formed material, are offset in the longitudinal direction on the upper side and underside of the web-formed material. In the same way, the flow spaces 41 and 42, through the metal plates of which gas is delivered away from the web-formed material, are offset in relation to one another in the longitudinal direction. This is also the case for the flow spaces 44 and 47 and also 45 and 46.

The floatation dryer 34 thus makes it possible for web-formed material which is to be dried to be dried on both sides. The number of flow spaces at the top and bottom is determined by the belt speed and the proportion of solvent in the material applied. This is also the case for other dryers having a plurality of flow spaces according to the invention.

Downstream of the floatation dryer 34, the web-formed material is then guided over a drum 50 and into a first post-treatment apparatus 52 and then also into a second post-treatment apparatus 54. In the post-treatment apparatuses 52, 54, the web-formed material can be post-treated by liquid and also gaseous media, in order for the web-formed material to be finished off. For example, contactless post-treatment of the web-formed material by means of liquid media takes place in the post-treatment apparatus 52 and contactless post-treatment of the web-formed material by means of hot gas takes place in the post-treatment apparatus 54. For the sake of simplicity, the web-formed material is not depicted within the post-treatment apparatuses 52 and 54. Downstream of the post-treatment apparatus 54, the dried and thus completed web-formed material 12 is then wound up on to a storage drum 56.

The illustration of FIG. 2 shows a further embodiment of a dryer 60 according to the invention. The dryer 60 is constructed in a manner similar to the dryer 18 of FIG. 1, but a respective airlock 62, 64 is arranged at the upstream end of the drying space 30 and at the downstream end. The airlocks 62 and 64 prevent ambient gas from entering into the drying space 30.

Liquid material is applied to the upper strand of the circulating belt 14 by means of an application device 16. The liquid material applied forms a liquid film on the upper strand of the belt 14. This liquid film is introduced into the drying space 30 through the airlock 62. The drying space 30 is bounded in the upward direction by a metal plate 20 made of open-pore and gas-permeable metal foam. The metal plate 20 has arranged above it the flow space 22, through which, as has already been explained with reference to FIG. 1 and the dryer 18 there, gas flows in the direction of the arrow 28. The gas 28 flows past the open pores of the metal plate 20 and thus sucks gas out of the drying space 30 into the flow space 22. The liquid film on the upper strand of the belt 14 can thus be dried uniformly over the entire underside of the metal plate 20 in that gas is extracted by suction from the drying space and thus from the surface of the liquid film. As the liquid film moves together with the upper strand of the belt 14, the film thus dries and, once it has passed through the downstream airlock 64 of the dryer 60, can be removed, in the form of a dried, stable sheet 66, from the belt 14 and fed, for example, to post-treatment. A drying speed can be optimized by means of height adjustment of the metal plate 20. A flow speed and a volume stream in the flow space 22 can be optimized by virtue of the height of the flow space 22 being changed. It may be expedient here for the volume stream to be optimized in, counter to and transversely to, the intake direction through the plate 20.

The airlocks 62, 64 here are designed in a manner described with reference to the dryer 34 of FIG. 1. The airlocks 62 and 64 each have two tubular rods 36, through which airlock gas is delivered in the direction of the film which is to be dried or in the direction of the sheet 66. The tubular rods 36 here each consist of gas-permeable metal foam, and therefore the airlock gas exits at low flow speed, and uniformly over the entire width of the film or of the sheet 66, in the direction of the latter. The film or the sheet is not adversely affected thereby, but it can be reliably ensured, at the same time, that no ambient gas enters into the drying space 30. The rods 36 can be adjusted in height relative to the belt 14 or to the material which is to be dried, so as to adjust the stream of airlock gas. This purpose is also served by the porosity of the rods 36 being selected appropriately.

The illustration of FIG. 3 shows a further embodiment of a dryer 70 according to the invention. The dryer 70 is designed in the form of a floatation dryer and thus in a manner comparable to the floatation dryer 34 explained in relation to FIG. 1. The dryer 70 of FIG. 3, however, has a total of four airlocks 72, 74, 76, 78, each having two tubular rods 36, which are each arranged at a distance from the web-formed material which is to be dried and through which airlock gas is delivered in the direction of the web-formed material which is to be dried. The tubular rods each consist of gas-permeable metal foam. The airlock 72 is arranged above the web-formed material 80 which is to be dried, at the upstream end of the first drying space 62, of which the downstream end is closed by the airlock 74. The airlock 76 is arranged at the upstream end of a second drying space 84, which is located between the underside of the web-formed material and the metal-foam plates of the flow space is beneath the web-formed material 80. The downstream end of the drying space 84 is closed off by the airlock 78.

The web-form material 80 is provided with a coating upstream of the floatation dryer 70, via an application device 16, and is then guided contactlessly through the dryer 70 and thus dried on its upper side and on its underside. A detailed explanation of the individual flow spaces of the dryer 70 is dispensed with here since said flow spaces are designed in a manner identical to the dryer 34, which has already been explained with reference to FIG. 1.

The illustration of FIG. 4 shows a further embodiment of a dryer 90 according to the invention. The dryer 90 is designed for continuous-belt operation and in a manner similar to the dryer 18, which has already been explained with reference to FIG. 1. In contrast to the dryer 18 of FIG. 1, a metal plate 92 made of open-pore metal foam is arranged obliquely in relation to a flat material 94 which is to be dried, and therefore a drying space 96 decreases in height in the movement direction of the material 94 which is to be dried. The metal plate 92 has arranged above it two flow spaces 98 and 100, through each of which gas is delivered counter to the movement direction of the web-formed material 94 on the upper strand of the circulating belt 14, so that gas is thus taken in from the drying space 96. The oblique positioning of the metal plate 92 makes it possible to set different flow conditions within the drying space 96. It is thus possible to set a lower negative pressure beneath the flow space 100 than beneath the flow space 98, in order to influence the drying behavior of the web-formed material 94 as it runs through the dryer 90.

The illustration of FIG. 5 shows a dryer 110 according to a further embodiment of the invention. The dryer 110 is designed in the form of a floatation dryer and thus in a manner similar to the dryer 34 already explained with reference to FIG. 1. In contrast to the floatation dryer 34 of FIG. 1, the porous, gas-permeable metal plates 112 of the flow spaces 114, 116, 118, 120, 122 and 124 are arranged at a first distance from the web-formed material 108 which is to be dried. Gas is delivered in the direction of the upper side and underside of the web-formed material 108 through the flow spaces 114, 116, 118, 120, 122, 124, so as to keep said material in a floating state between the metal plates 112. In contrast, gas is extracted by suction from the flow spaces 115, 117, 119, 121, 123 and 125. The porous, gas-permeable metal plates 126, by means of which each of the flow spaces 115, 117, 119, 121, 123 and 125 are closed, are arranged at a second distance from the upper side and the underside of the web-formed material 108, wherein the second distance is greater than the first distance, by which the porous, gas-permeable metal plates 112 are spaced apart from the web-formed material 108. Such a measure allows the web-formed material 108 to be reliably kept in a floating state and thus dried in a contactless manner. It can also be seen that the surface areas of the metal plates 112 are nearly half the size of the surface areas of the metal plates 126. This also gives rise, on the one hand, to reliable drying and, on the other hand, to the situation where the web-formed material can be reliably kept in a floating state.

The illustration of FIG. 6 shows a further dryer 130 according to the invention, which is designed in the form of a floatation dryer for drying both sides of a web-formed material 132. The dryer 130 has a total of 5 flow spaces 134 above the web-formed material 132 and five flow spaces 136 which are identical, but arranged beneath the web-formed material 132, each flow space being bounded in the direction of the web-formed material 132 by means of a porous, gas-permeable metal plate and having gas delivered through it in the direction of the web-formed material 132. The dryer 130 also has four flow spaces 138, which are arranged above the web-formed material and are bounded in the direction of the web-formed material 132 likewise by means of a porous, gas-permeable metal plate. Four flow spaces 140, which are identical to the flow spaces 138, are arranged beneath the web-formed material 132. Gas is extracted by suction from the flow spaces 138 and 140, and this therefore gives rise to a negative pressure between the porous, gas-permeable metal plates of the flow spaces 138 and 140 and the upper side and the underside, respectively, of the web-formed material 132. In the case of the dryer 130, the flow spaces 134 and 136 are arranged precisely opposite one another and the surface area of the porous gas-permeable metal plates of the flow spaces 134 and 136 is essentially double the surface area of the porous, gas-permeable metal plates of the flow spaces 138 and 140. The porous, gas-permeable metal plates of the flow spaces 138 and 140 are also arranged at a greater distance from the upper side and the underside, respectively, of the web-formed material 132 than the porous, gas-permeable metal plates of the flow spaces 134 and 136. The level of the negative pressure by means of which gas is extracted by suction from the respective drying space and also the level of the positive pressure and/or of the flow speed by means of which the web-formed material 132 is kept in a floating state are set in dependence on the type of web-formed material 132 which is to be dried. Airlocks 142 are arranged in each case upstream and downstream of the drying spaces of the dryer 130.

The dryers of FIGS. 5 and 6 may also be arranged, and operated, vertically, for example for sheets coated on both sides.

The illustration of FIG. 7 shows a further dryer 150 according to the invention. The dryer 150 is designed in the form of a contactless dryer and a web-formed material 152 which is to be dried is guided vertically between two porous, gas-permeable metal plates 154 made of metal foam. Drying gas flows through each of the metal plates 154 in the direction of the web-formed material 152 which is to be dried. The drying gas is then extracted by suction again, from the drying spaces on both sides of the web-formed material 152, in the direction of the upper end of each drying space.

The illustration of FIG. 8 shows a dryer 160 according to a further embodiment of the invention. A web-formed material which is to be dried here is guided in meandering fashion between porous, gas-permeable metal plates 164 and is thus dried in a contactless manner on both sides. A deflecting region 166, in which the web-formed material 162 has to be kept in a floating state counter to its gravitational force, has a curved porous, gas-permeable metal plate made of metal foam 168, through which gas is delivered in the direction of the web-formed material 162 in order to deflect said material and keep it at a distance from the metal plate 168.

The illustration of FIG. 9 shows a further dryer 170 according to a further embodiment of the invention. The dryer 170 is provided for so-called batch operation, in which therefore for example a coated glass panel 172 which is to be dried is introduced into a drying space 174, is then fully dried there and only then is removed again from the drying space 174. The drying space 174 is bounded, on the one hand, by the coated glass panel 172 which is to be dried and, on the other hand, by a metal-foam plate 176. The metal-foam plate 176 is arranged in a height-adjustable manner and can thus be coordinated with different flat materials which are to be dried. The metal-foam plate 176 has arranged above it a flow space 178, from which gas is extracted by suction by means of an extraction fan 180. Coming from the surroundings or from a gas source, gas flows into the flow space 178 via a heat exchanger 182. A first flow straightener 184 is arranged on the inlet side of the flow space 178, that is to say directly downstream of the heat exchanger 182, and a further flow straightener 186 is arranged at the outlet opening of the flow space 178. The flow straighteners 184, 186 each comprise open-pore metal-foam plates and thus ensure very uniform flow conditions within the flow space 178. Gas is sucked into the flow space 178 from the drying space 174 via the Venturi effect.

The illustration of FIG. 10 shows a further dryer 190 according to a further embodiment of the invention. The illustration of FIG. 10 is merely schematic and serves to portray a cover 192 which, together with a fixed base 194, forms a closed-off space. This closed-off space contains, on the one hand, the flat material 196 which is to be dried and also a drying space 198, which is bounded in the direction of its upper side by a metal-foam plate 200. The metal-foam plate has arranged above it a flow space 202, through which gas is directed in order, in turn, for gases to be taken in from the drying space 198 via the Venturi effect. The flow space 202 is thus bounded, on the one hand, by the metal-foam plate 200 and, on the other hand, by a cover 204. An interspace, through which, in turn, gas can pass laterally into the drying space 198, is located between the cover 204 and the cover 192.

The illustration of FIG. 11 shows, schematically, a further dryer 210 according to the invention. The dryer 210 is designed in the manner of a continuous tunnel and has a curved metal-foam plate 212, which bounds a drying space above a flat material 214 which is to be dried. The curved metal-foam plate 212 has arranged above it a cover 216, which defines a flow space 218 between itself and the metal-foam plate 212. The cover 216 rests on a fixed base 220.

The invention claimed is:

1. A dryer for flat materials comprising a porous, gas-permeable metal plate for arranging at a distance from a flat material which is to be dried, and a suction arrangement for suctioning a gaseous fluid through the metal plate, and wherein the metal plate consists of a metal foam.

2. The dryer as claimed in claim 1, wherein the suction arrangement includes an intake for taking in gas from a region between the metal plate and the flat material which is to be dried.

3. The dryer as claimed in claim 2, wherein the suction arrangement has at least one flow space, which is bounded on one side by a surface of the metal plate, wherein the surface of the metal plate is directed away from the flat material which is to be dried, wherein the at least one flow space has at least one entry opening and at least one exit opening for delivery gas and is designed to guide the delivery gas past the surface of the metal plate which is located in the at least one flow space in order to generate an intake action through the metal plate.

4. A method for drying flat materials comprising arranging at least one metal plate made of porous, gas-permeable metal foam at a distance from the flat material which is to be dried and delivering gaseous fluid through the metal plate.

5. The method as claimed in claim 4, wherein the flat material which is to be dried is guided past the metal plate.

6. The method as claimed in claim 4, including taking in gaseous fluid through the metal plate from a region between the flat material and the metal plate.

7. The method as claimed in claim 4, wherein arranging at least one metal plate includes arranging a first metal plate at a distance from a first surface of the flat material and arranging at least a second metal plate at a distance from a second surface of the flat material and delivering gaseous fluid through the first and second metal plates.

8. The method as claimed in claim 7, including a contactless drying of the flat material in the region between the two metal plates.

9. The method as claimed in claim 4, including guiding delivery gas past a metal-plate surface which is directed away from the flat material which is to be dried and taking in gaseous fluid through the metal plate by the delivery gas guided past the metal-plate surface.

10. A dryer for flat materials comprising a porous, gas-permeable metal plate for arranging at a distance from the flat material which is to be dried, wherein means are provided for delivering a gaseous fluid through the metal plate, and wherein the metal plate consists of a metal foam.

11. The dryer as claimed in claim 10, wherein the means for delivering a gaseous fluid has an intake for taking in gas from a region between the metal plate and the flat material which is to be dried.

12. The dryer as claimed in claim 11, wherein the means for delivering a gaseous fluid have at least one flow space, which is bounded on one side by a surface of the metal plate, wherein said surface is directed away from the flat material which is to be dried, wherein the at least one flow space has at least one entry opening and at least one exit opening for delivery gas and is designed to guide the delivery gas past the surface of the metal plate which is located in the flow space, in order to generate an intake action through the metal plate.

13. The dryer as claimed in claim 12, wherein a plurality of flow spaces, each with at least one entry opening and at least one exit opening, are arranged one behind the other in a longitudinal direction of the flat material which is to be dried.

14. The dryer as claimed in claim 10, wherein the metal plate is arranged above a circulating belt, to which a liquid material is applied in order to produce the flat material, said flat material solidifying on the belt.

15. The dryer as claimed in claim 10, comprising at least one airlock upstream and/or downstream of a drying space of the dryer, wherein the airlock has at least one bar-like or rod-like strip arranged transversely to a longitudinal direction of the flat material which is to be dried, wherein the flat material is moved past the strip in the longitudinal direction, wherein the strip, at least over a part of an outer surface thereof which is directed toward the flat material, consists of porous, gas-permeable metal foam, and wherein means are provided for delivering airlock gas through the metal foam in a direction of the flat material.

16. The dryer as claimed in claim 10, wherein the metal foam consists of a stainless steel.

17. The dryer as claimed in claim 16, wherein the metal foam is between 45 percent and 80 percent nickel and between 15 percent and 45 percent chromium.

18. The dryer as claimed in claim 17, wherein the metal foam has carbon, copper, iron, molybdenum, manganese, phosphorus and/or zinc, the percentage of each being less than 1 percent.

19. The dryer as claimed in claim 10, wherein the metal foam has a porosity of 90 percent or more.

20. The dryer as claimed in claim 10, wherein the metal foam has an average pore size ranging between 0.3 mm and 2.5 mm.

* * * * *